US005558034A

United States Patent [19]

Hodapp

[11] Patent Number: 5,558,034

[45] Date of Patent: Sep. 24, 1996

[54] LIFT TRANSPORTABLE WITH PONTOON BOATS OR THE LIKE

[76] Inventor: Gary Hodapp, R.R. #4, Box 212, Mankato, Minn. 56001

[21] Appl. No.: 271,032

[22] Filed: Jul. 6, 1994

[51] Int. Cl.[6] ..... B63B 17/00

[52] U.S. Cl. ..... 114/44; 384/439; 403/119; 405/3

[58] Field of Search ..... 114/44, 344; 405/3, 405/203; 403/119, 161; 384/276, 295, 296, 439

[56] References Cited

U.S. PATENT DOCUMENTS

| | | | |
|---|---|---|---|
| 2,664,577 | 1/1954 | Sanborn | 114/344 |
| 3,300,796 | 1/1967 | Powers | 114/344 |
| 3,479,828 | 11/1969 | Luque . | |
| 3,753,355 | 8/1973 | Knoch | 405/3 |
| 3,800,727 | 4/1974 | Stark et al. | 114/202 |
| 3,879,781 | 4/1975 | Roschynialski | 114/344 |
| 4,070,978 | 1/1978 | Virgilio | 114/26 |
| 4,254,730 | 3/1981 | Crenshaw | 114/294 |
| 4,494,883 | 1/1985 | Winter | 384/276 X |
| 4,773,346 | 9/1988 | Blanding et al. | 114/45 |
| 5,042,417 | 8/1991 | Raymond | 114/343 |
| 5,115,753 | 5/1992 | Craddock | 114/48 |
| 5,163,378 | 11/1992 | Raymond | 114/44 |
| 5,184,561 | 2/1993 | Nickell, Jr. | 114/61 |
| 5,184,914 | 2/1993 | Basta | 405/3 |

FOREIGN PATENT DOCUMENTS

| | | | |
|---|---|---|---|
| 2345754 | 3/1975 | Germany | 403/119 |

*Primary Examiner*—Sherman Basinger

*Attorney, Agent, or Firm*—Peterson, Wicks, Nemer & Kamrath, P.A.

[57] ABSTRACT

Front and rear lifts (10) of the present invention are secured to the platform (14) of a pontoon boat (12) intermediate the flotation units (20). A U-shaped lift module (32) including first and second legs (36) extending from a central spindle (34) is pivoted about pivot pins (64) relative to first and second mounts (26) by actuators (74) extending between the mounts (26) and the legs (36) between a retracted position generally parallel to and adjacent the platform (14) and a lift position extending at an acute angle to the platform (14). The legs (36) each include first and second C-shaped posts (38) extending from the central spindle (34) and slideably received in first and second tubes (42). Bolts (52) extend through an aperture formed in the outer side wall (46) of the tubes (42), extend through one of a series apertures (40) formed in the C-shaped posts (38), and are threaded into sleeves (48) secured to the inner side walls (44) of the tubes (42) by bolts (50). The actuators (74) are pivotally received between the first and second posts (38) and tubes (42). A ground support pad (54) is pivotally mounted by U-shaped straps (62) to the central spindle (34). Pivot bushings (66) are secured in the tubes (42) by deforming the side walls (44, 46) and slideably receive the pivot pins (64) between the legs (36) and the mounts (26) and between the legs (36) and the actuators (74).

23 Claims, 3 Drawing Sheets

LIFT TRANSPORTABLE WITH PONTOON BOATS OR THE LIKE

BACKGROUND

The present invention generally relates to lifts for watercraft, particularly to lifts which are transported with the watercraft, and specifically to transportable lifts for pontoon boats or the like.

It is desirable to lift watercraft out of the water when not in use so that the bottom of the watercraft is not continually exposed to the water and also so that the watercraft does not continually bang against the dock or shore due to waves or wakes from other watercraft passing by. Conventional watercraft lifts are stationary, i.e. typically adjacent to a dock, and include a platform which is submersible under the water below the watercraft (with the watercraft floating on the platform when submersed) and which can be raised with the watercraft thereon above the water. It can be appreciated that the dock and watercraft lift are required to be taken out of the water when the body of water freezes in the winter. Also, watercraft lifts are generally water level dependent such that as the water level drops (which typically occurs in the summer), it may be necessary to move the watercraft lift further towards the center of the body of water as the depth of the water changes adjacent to the shore (or vice versa if the water level should rise such as by excessive rainfall). Likewise, the watercraft at locations away from the stationary lift experiences the disadvantages of remaining in the water.

Thus, a need exists for lifts which are attached to and transported with the watercraft. Although lifts transportable with boats currently exist, such transportable lifts have not gained wide market acceptance for several reasons including but not limited to their large and bulky size, their unaesthetic appearance, their inability to be installed easily to existing watercraft, and the like.

Thus, a need continues to exist for lifts which are attached to and transported with the watercraft and which overcome the shortcomings and disadvantages of prior watercraft transportable lifts.

SUMMARY

The present invention solves this need and other problems in the field of lifts for watercraft by providing, in the preferred form, a leg pivotally mounted to a mount securable to the watercraft with the leg including first and second, spaced, parallel, elongated members pivotally received between first and second, spaced, parallel, elongated braces forming the mount. In the most preferred form, an actuator pivotally mounted to the mount and leg is pivotally received between the elongated members of the leg.

In a further aspect of the present invention, surfaces defining apertures in first and second side walls are deformed to abut with radial shoulders formed in the inner bore spaced axially inward from the axial ends of a pivot bushing.

In other aspects of the present invention, a U-shaped lift module is pivotally mounted to first and second mounts between a retracted position adjacent to the watercraft and a lift position engaging the water body bottom and spaced from the watercraft wherein the watercraft is raised above the water surface.

In still other aspects of the present invention, guide pads are mounted to the inside surfaces of the mount to cam against the outside surfaces of the leg as it is being pivotally received in the spacing between the inside surfaces.

It is thus an object of the present invention to provide a novel lift for watercraft.

It is further an object of the present invention to provide such a novel watercraft lift especially adapted for pontoon boats.

It is further an object of the present invention to provide such a novel watercraft lift transportable with the watercraft.

It is further an object of the present invention to provide such a novel watercraft lift which does not detrimentally affect operation of the watercraft on the water.

It is further an object of the present invention to provide such a novel watercraft lift transportable with the watercraft when road transporting the watercraft.

It is further an object of the present invention to provide such a novel watercraft lift which is adjustable for deeper and shallower water conditions and for variable contours of the water body bottom.

It is further an object of the present invention to provide such a novel watercraft lift which is easy to ship, store, and install.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
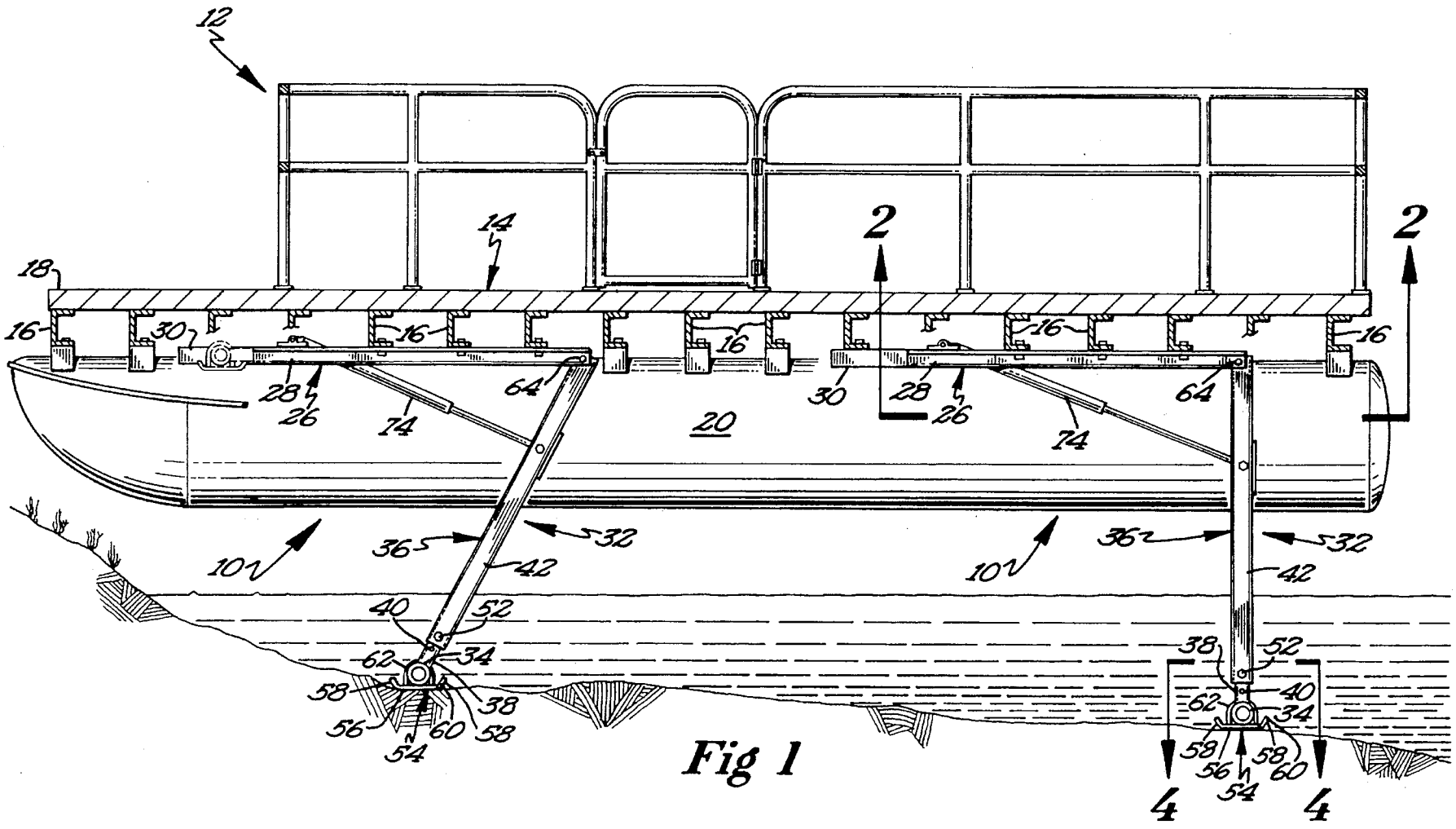
FIG. 1 shows a cross-sectional view of a pontoon boat including a transportable lift according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

where used in the various figures of the drawings, the same numerals designate the same or similar parts. Furthermore, when the terms "top", "bottom", "first", "second", "front", "back", "outer", "inner", "upper", "lower", "height", "width", "length", "end", "side", "horizontal", "vertical", "lateral", and similar terms are used herein, it should be understood that these terms have reference only to the structure shown in the drawings as it would appear to a person viewing the drawings and are utilized only to facilitate describing the invention.

DESCRIPTION

Figure 2:
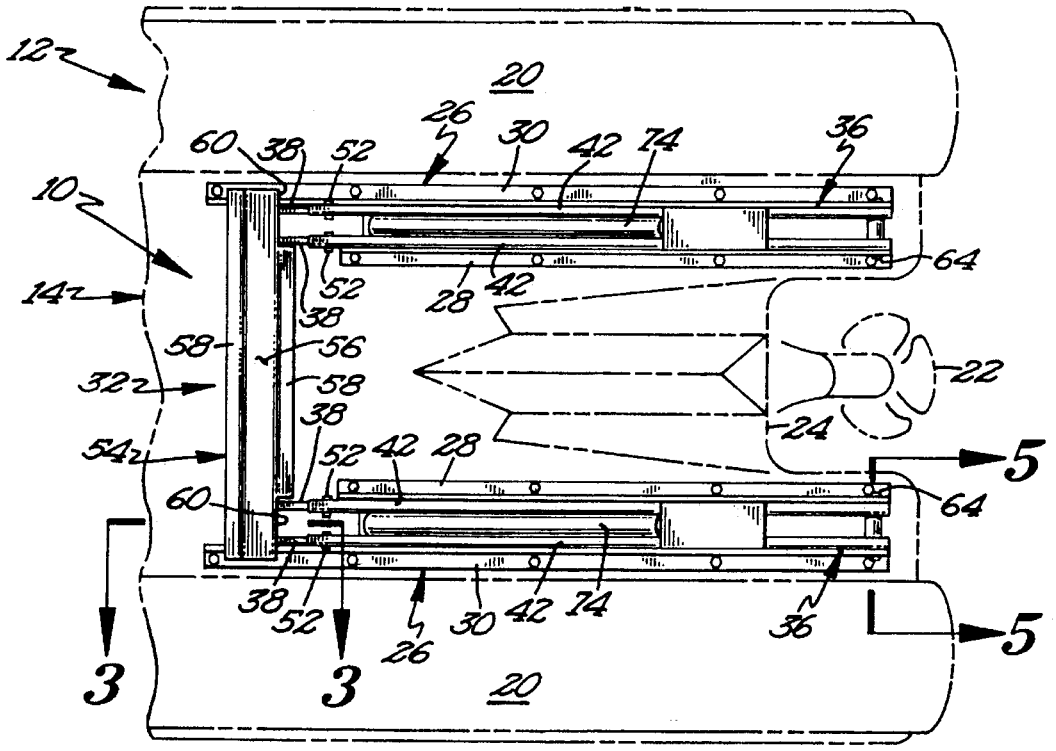
FIG. 2 shows a partial, bottom plan view of the lift of FIG. 1 in its retracted or stored position according to view line 2—2 of FIG. 1.
Figure 3:
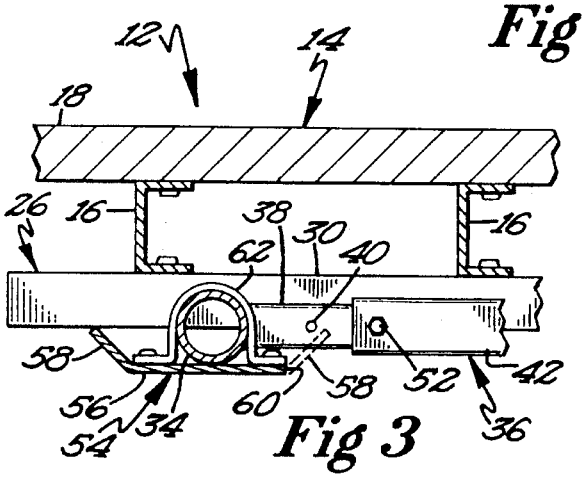
FIG. 3 shows a cross-sectional view of the lift of FIG. 1 according to section line 3—3 of FIG. 2.
Figure 4:
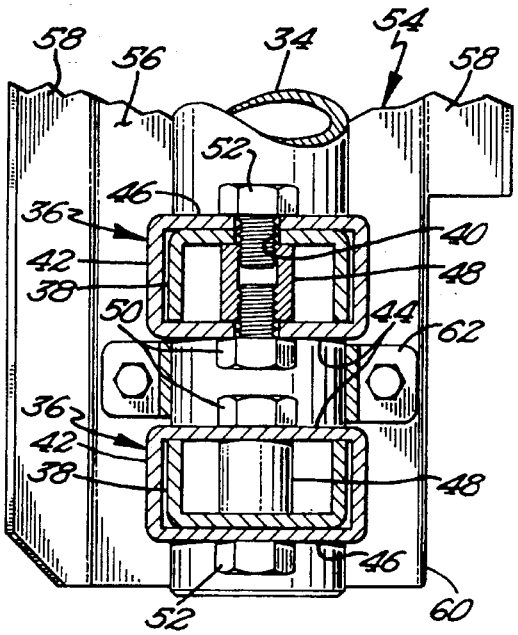
FIG. 4 shows a cross-sectional view of the lift of FIG. 1 according to section line 4—4 of FIG. 1.
Figure 5:
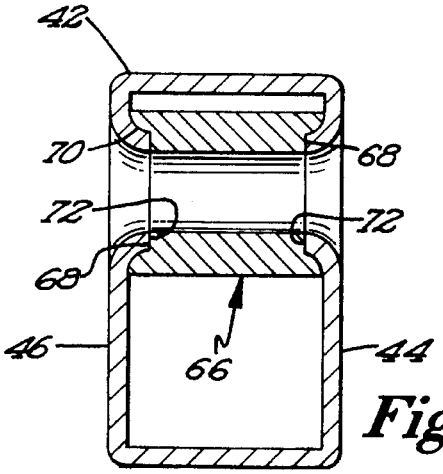
FIG. 5 shows a cross-sectional view of the lift of FIG. 1 according to section line 5—5 of FIG. 2.

A lift for watercraft and especially pontoon boats or the like according to the preferred teachings of the present invention is shown in the drawings and generally designated 10. Pontoon boat 12 generally includes a platform 14 having a plurality of cross members 16 supporting suitable deck material 18. Pontoon boat 12 further generally includes first and second, spaced, parallel, flotation units 20 located at the opposite ends of cross members 16. An outboard motor 22, partially shown in phantom in FIG. 2, is normally mounted on a transom 24 located at the rear of platform 14 and intermediate flotation units 20.

Lift 10 according to the preferred teachings of the present invention includes first and second, spaced, parallel mounts 26 suitably secured to an attachment surface on platform 14 parallel to and adjacent flotation units 20. In the most preferred form, each of mounts 26 is formed from inner and outer, elongated braces 28 and 30 each having a generally L-shape. In the most preferred form, braces 30 have a greater length than braces 28. Braces 28 and 30 are secured to platform 14 by any suitable means with their first legs being arranged in a spaced, vertical manner extending downward from platform 14 and with their second legs extending horizontally outwardly from the first legs and abutting with the lower edges of cross members 16.

Lift 10 according to the preferred teachings of the present invention further includes a generally U-shaped lift module 32 pivotably mounted to first and second mounts 26. In particular, lift module 32 generally includes a central spindle 34 shown in the preferred form as a cylindrical tube. First and second legs 36 extend from adjacent the opposite ends of central spindle 34 in a parallel manner and spaced corresponding to and for receipt between the first legs of braces 26 and 28 of first and second mounts 26. In the preferred form, legs 36 have a variable length and in the most preferred form are telescopic.

In the most preferred form, first and second telescopic legs 36 each include first and second C-shaped posts 38 having their first ends integrally secured to central spindle 34 such as by welding. Posts 38 are secured with their central portions being parallel and perpendicular to the axis or length of central spindle 34 and their leg portions extending towards each other from the central portions. The central portions of posts 38 include a series of apertures 40 in the slide direction parallel to central spindle 34 and spaced at equal intervals from central spindle 34. The spacing between the outer surfaces of the central portions of first and second posts 38 is less than the spacing between the first, vertical legs of braces 28 and 30, with the free ends of the leg portions of first and second posts 38 being spaced.

In the most preferred form, first and second telescopic legs 36 each further include first and second hollow tubes 42 having a generally rectangular annular cross section of a size and shape for slideably receiving C-shaped posts 38. Each of the inner and outer side walls 44 and 46 of tubes 42 parallel to the central portions of posts 38 include an aperture parallel to central spindle 34. The apertures in side walls 44 and 46 of tubes 42 are laterally aligned.

Each first and second hollow tube 42 includes a threaded sleeve 48 having a length generally equal to the height of the leg portions from the central portions of posts 38. Sleeve 48 is secured inside of tubes 42 by bolts 50 extending through the apertures of inner side walls 44 of tubes 42 of both legs 36 and threaded into sleeve 48. It can then be appreciated that the central portions of posts 38 are slideably received between outer side walls 46 of tubes 42 and the free ends of sleeves 48 opposite bolts 50 for movement between extended and retracted positions. Posts 38 can then be slid relative to tubes 42 to the desired length with one of apertures 40 aligned with sleeve 48. At that time, bolts 52 can be inserted through the aligned apertures 40 and threaded into sleeve 48 to thus hold posts 38 and tubes 42 in the desired position. If the relative position of posts 38 and tubes 42 is desired to be changed, bolts 52 are removed, allowing sliding of posts 38 in tubes 42 to the desired position where bolts 52 are again secured, with bolts 50 remaining threaded in sleeves 48 at all times after assembly. It can then be appreciated that sleeves 48 could be integrally or otherwise secured to tubes 42 such as by welding if desired.

Lift module 32 according to the preferred teachings of the present invention further includes a pad 54 pivotally secured to central spindle 34. Specifically, pad 54 includes a first linear plate 56 extending generally tangentially to the cylindrical outer surface of central spindle 34 and of a length larger than the diameter of spindle 34 such that pad 54 has sufficient area for lake bottom support and in the most preferred form is of a length generally double the diameter of spindle 34. Front and rear linear plates 58 extend at an acute angle in the order of 45° in the most preferred form shown from the edges of plate 56 on opposite sides of spindle 34. Rear linear plate 58 includes removed portions 60 at the ends thereof, with rear linear plate 58 being of a shorter length than front linear plate 58 as the result of removed portions 60 in the most preferred form. U-shaped straps 62 extend around spindle 34 intermediate first and second posts 38 of each leg 36 and are secured to plate 56 to pivotally mount pad 54 to spindle 34 about a pad axis while preventing relative axial movement.

The upper, free ends of tubes 42 of legs 36 are pivotally attached by pins 64 to mounts 26 between braces 28 and 30, with pins 64 defining a lift pivot axis extending perpendicular to braces 28 and 30 of mounts 26. In the most preferred form, tubes 42 are formed of an extruded aluminum alloy due to its lightweight and non-corrosiveness. Because of the non-wearing characteristics of aluminum, harder metal alloy pivot points are desired for pins 64 in tubes 42. In the most preferred form, lift 10 includes pivot bushings 66 formed from material having desirable wear characteristics such as stainless steel or the like. Radial shoulders 68 are formed in the inner bore, spaced axially inward from both axial ends of bushings 66, and of a depth generally equal to the thickness of side walls 44 and 46 of tubes 42. Both axial ends of each bushing 66 are arcuately shaped as at 70 from the outer surface of bushing 66 to shoulder 68. After apertures 72 are formed in side walls 44 and 46 of each tube 42 and bushing 66 is positioned between side walls 44 and 46 and aligned with apertures 72, side walls 44 and 46 of tubes 42 extending perpendicular to the tilt axis defined by pins 64 are pressed and deformed inwardly into tube 42 until the surfaces defining apertures 72 abut with shoulders 68 and are generally parallel to side walls 44 and 46 in a nondeformed condition, with side walls 44 and 46 being deformed to also abut with arcuate shape 70 of the axial ends of bushing 66. Thus, bushings 66 are rigidly secured in tubes 42 of legs 36. Pins 64 can then be slideably received in the inner bores of bushings 66 such that frictional wear arising from pivoting of legs 36 relative to mounts 26 is minimized.

Lift 10 according to the preferred teachings of the present invention further includes suitable provisions for pivoting lift module 32 relative to mounts 26 between a retracted position generally coextensive with mounts 26 and parallel to and adjacent platform 14 and a lift position at an acute angle up to 90° from mounts 26 and platform 14. In the most preferred form, first and second hydraulic actuators 74 are utilized each having a first end pivotally secured between braces 28 and 30 of first and second mounts 26 and a second end pivotally secured between first and second tubes 42 of first and second legs 36 at locations spaced from and parallel to pins 64. Suitable means, not shown, are provided to simultaneously extend or retract first and second actuators 74. In the most preferred form, bushings 66 are also utilized at the pivotable securement points of actuators 74 to tubes 42. Further, in the form shown, the pivot pins of the first ends of actuators 74 are pivotally secured by U-shaped straps secured to the upper surfaces of the second, horizontal legs of braces 28 and 30 intermediate two cross members 16 of platform 14. Alternately, the pivot pins of the first ends of actuators 74 could be in the form of bolts extending between the first, vertical legs of braces 28 and 30. The pivot pins of the second ends of actuators 74 are spaced from pivot pins 64 less than the depth of flotation units 20 such that actuators 74 will not be submerged in water when flotation units 20 are raised above the water. Actuators 74 have a diameter for receipt between tubes 42 and between braces 38 and 30 of mounts 26 in the retracted position.

Figures 6, 7:
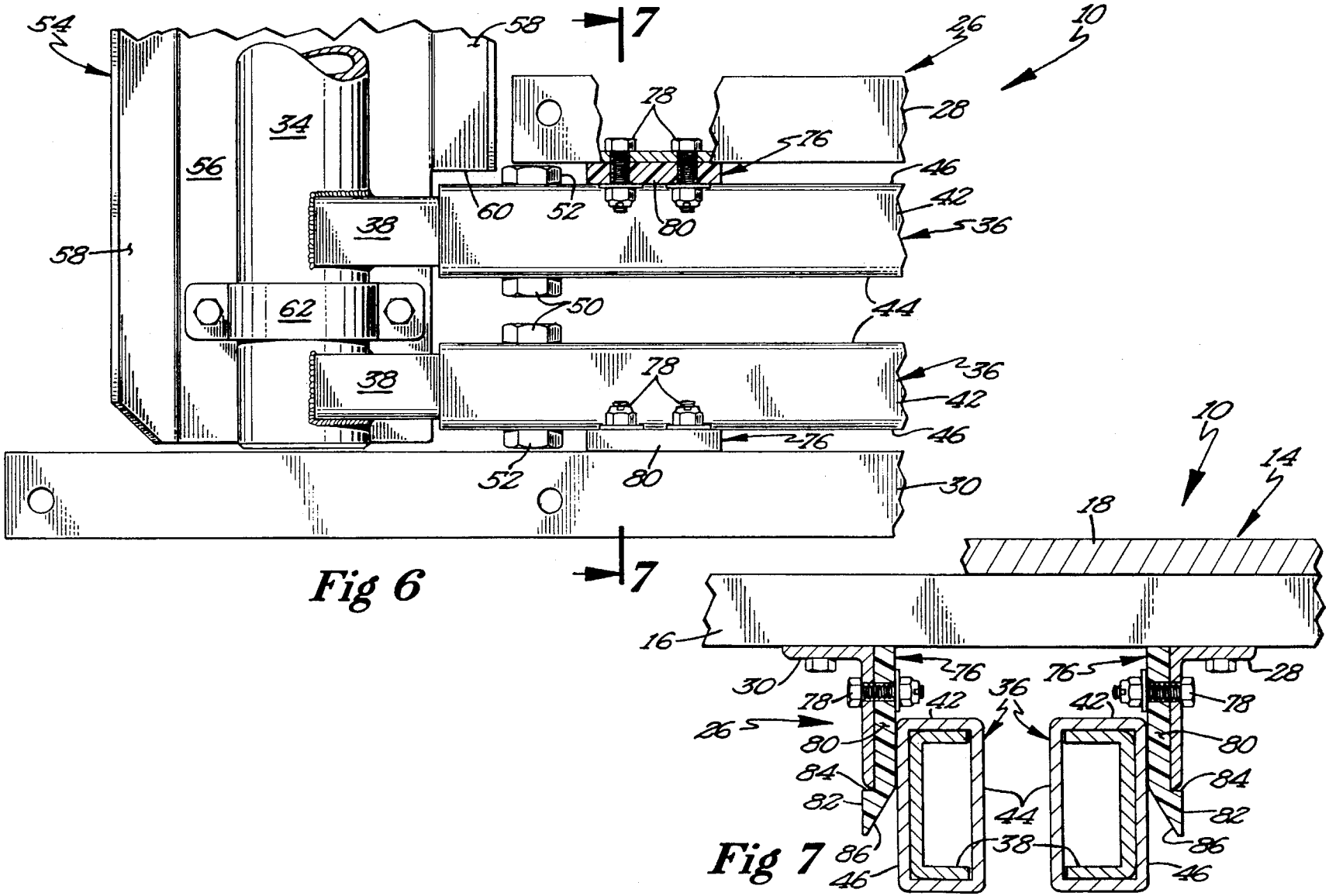
FIG. 6 shows a partial, top plan view of a transportable lift according to the preferred teachings of the present invention in its retracted or stored position.
FIG. 7 shows a cross-sectional view of the lift of FIG. 6 according to section line 7—7 of FIG. 6.

In the preferred form shown in FIGS. 6 and 7, guide pads 76 are secured to braces 28 and 30 such as by bolts 78 intermediate the pivot location of actuators 74 to mounts 26 and the free ends of tubes 42 in their retracted position. Guide pads 76 are formed of suitable, wear resistant, resilient, noncorrosive material such as polyethylene. Specifically, guide pads 76 include a rectangular body portion 80 having an outside surface for abutment with the inside surfaces of the first, vertical legs of braces 28 and 30, with bolts 78 extending through body portion 80 in the most preferred form. Guide pads 76 further include a generally right triangular shaped head portion 82. Head portion 82 generally includes a shoulder 84 extending generally perpendicularly outward of the outside surface of body portion 80 and abuts with the lower edges of the first, vertical legs of braces 28 and 30. Head portion 82 further includes an inclined inner surface 86 extending from the inside surface of body portion 80 outwardly to a point located outside of the outside surface of body portion 80 and the inside surfaces of the first, vertical legs of braces 28 and 30.

Now that the basic construction of lift 10 according to the preferred teachings of the present invention has been explained, the operation and subtle features of lift 10 can be set forth and appreciated. In the retracted position, lift 10 has a minimal presence on boat 12 to allow operation including unrestricted water flow under platform 14 similar to that of boat 12 without lift 10 and to allow transport of boat 12 including lift 10 on conventional trailering devices when road transporting boat 12. Specifically, lift 10 in the most preferred form protrudes downward from cross members 16 only 5 inches (12.7 cm) in the retracted position. In particular, legs 36 are sized to be pivotable within the vertical extent of mounts 26 and actuators 74 are sized to be pivotable within the vertical extent of mounts 26 and within tubes 42 of legs 36. Further, pad 54 is specifically designed such that plate 56 is parallel to platform 14 in the retracted position. Specifically, as lift module 32 pivots toward the retracted position, and assuming for the sake of explanation that the free edge of front plate 58 first engages braces 28 and/or 30, pad 54 will pivot on spindle 34 as lift module 32 continues to pivot. It should be noted that due to removed portions 60, rear plate 58 does not abut with posts 38 secured to spindle 34. When lift module 32 reaches the retracted position as shown in phantom in FIG. 1, pad 54 is locked in position with plate 56 parallel to platform 14 by the abutment of the free edge of front plate 58 with braces 30 of first and second mounts 26 and/or the abutment of the free edges of plate 56 within removed portions 60 with C-shaped posts 38. Thus, pad 54 and lift module 32 does not detrimentally protrude from platform 14 according to the preferred teachings of the present invention. It should however be appreciated that although pad 54 is pivoted to its non-protruding position due to the abutment with mounts 26 and/or posts 38 and is believed to be advantageous, pad 54 could be otherwise moved into a non-protruding position such as by a linkage arrangement.

Further, as lift module 32 pivots towards the retracted position, guide pads 76 will cam legs 36 to pass into and between braces 28 and 30. Specifically, if legs 36 are not aligned with the spacing between braces 28 and 30, the outside surface of one of tubes 42 will engage with inclined inner surface 86 of the corresponding guide pad 76. Due to its incline, surface 86 will cam tube 42 toward the center of the spacing between braces 28 and 30 as tube 42 is pivoted to its retracted position such that tube 42 will slide between the inside surfaces of body portions 80. It can be appreciated that the abutment of shoulder 84 with the lower edges of the first, vertical legs of braces 28 and 30 assists in preventing the deformation of head portions 82 when tubes 42 engage surfaces 86. It can then be appreciated that legs 36 can be misaligned with the spacing between braces 28 and 30 such as the result of improper placement of mounts 26 on boat 12, the distortion of platform 14 and/or lift 10 such as from age, and the like. Guide pads 76 according to the teachings of the present invention are then advantageous in insuring that legs 36 will pass between braces 28 and 30 and to prevent wear due to rubbing between legs 36 and braces 28 and 30.

When it is desired to lift boat 12 from the water, actuators 74 are actuated to pivot lift module 32 from the retracted position. Specifically, as actuators 74 expand from their retracted condition, lift module 32 pivots relative to mounts 26 about pins 64. As lift module 32 pivots relative to mounts 26, the vertical spacing of pad 54 from platform 14 increases to engage the water surface, then be submersed in the water, and then to engage the bottom of the water body. Due to the pivotable mounting of pad 54, pad 54 will pivot on spindle 34 to match and/or make full contact with possible irregular contours of the water body bottom. When pad 54 is in full contact with the water body bottom and provides a support surface therewith and with further pivoting of lift module 32 and increased spacing of pad 54 from platform 14, lift 10 will raise boat 12 relative to the water body bottom, with lift module 32 being pivoted until flotation units 20 of boat 12 are positioned above the water surface at the desired height. In this position, actuators 74 can be at their fully extended condition with lift module 32 being generally vertical and at a right angle to platform 14 in the most preferred form, or can be not fully extended such as with lift module 32 at an angle less than 90° to platform 14. It should be appreciated that the vertical spacing of pad 54 from platform 14 in the lift position of lift module 32 can be adjusted by telescoping posts 38 into or out of tubes 42 in a manner as previously discussed or by other manners such as but not limited to by actuators which slide posts 38 relative to tubes 42 and which may be positioned inside of tubes 42.

It should be appreciated that the particular construction of lift module 32 and lift 10 according to the preferred teachings of the present invention is believed to be particularly advantageous for additional reasons. Specifically, pad 54 as shown and described provides a large support surface allowing lift 10 to support boat 12 on softer water body bottoms. Likewise, due to its pivotable mounting, pad 54 is able to match and make full contact with the water body bottom. However, lift module 32 can utilize other types and constructions of pad 54 or can omit pad 54 altogether, with spindle 34 possibly having other shapes and forms to provide the necessary support surface with the water body bottom. Similarly, the U-shape of lift module 32 of the preferred form is believed to be particularly advantageous for at least strength and support surface area reasons. However, other forms and types of lift modules 32 can be utilized in lift 10 according to the preferred teachings of the present invention. For example, first and second legs 36 of lift modules 32 could be separate from each other and could be independently operable to allow lifting from side-to-side at differing heights from the water body bottom.

In the most preferred form of the present invention, front and rear lifts 10 are utilized on boat 12, with lifts 10 being arranged with pads 54 located forward of pins 64 in the retracted position. It can then be appreciated that the U-shape of lift module 32 allows first and second mounts 26 to be located on opposite sides of transom 24 and lift module 32 to fit around transom 24 in the retracted position of rear lift 10 as best seen in FIG. 2. In the most preferred form, front and rear lifts 10 are independently operable so that lift modules 32 can be pivoted at different angles between front and rear lifts 10. For example, the bottom of a body of water typically will slope gradually downward from the shoreline. Assuming boat 12 is docked with the front towards the shoreline as shown in FIG. 1, lift module 32 of front lift 10 can be pivoted at a lesser angle than lift module 32 of rear lift 10 such that pad 54 of front lift 10 has a lesser vertical spacing from platform 14 than pad 54 of rear lift 10 such that platform 14 can be positioned level with the water surface even though the bottom of the body of the lake does not.

It should be appreciated that the use of separate front and rear lifts 10 are believed to be advantageous for other reasons. First, front and rear lifts 10 can be mounted at any desired spacing on boat 12 for more even weight distribution on lifts 10 according to the particular boat 12. Additionally separate lifts 10 are easier to handle during shipping, storage, and installation than if constructed as being unitary.

Now that the basic teachings of the present invention have been explained, many extensions and variations will be obvious to one of ordinary skill in the art. For example, although legs 36 of lift module 32 are each formed of first and second, telescopic, posts 38 and tubes 42 in the most preferred form, legs 36 could be formed of a single, elongated member which could be of a fixed or a variable length according to the teachings of the present invention. Likewise, although two actuators 74 are utilized to pivot lift module 32 in the most preferred form, a single actuator 74 or other means could be utilized according to the teachings of the present invention. Further, the front module 32 could be tied via an adjustable linkage to the rear module 32, with acuator(s) 74 utilized in one or both of the front and rear lifts 10. Additionally, although the utilization of pivot bushings 66 of the most preferred form is believed to be advantageous, lifts 10 according to the teachings of the present invention could include pivot bushings 66 of other constructions and/or styles and/or include other pivot arrangements.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Lift for a watercraft having an attachment surface comprising, in combination: first and second mounts securable to the attachment surface of the watercraft in a spaced relation; a lift module of a generally U-shape and including first and second legs extending from a central spindle and having free ends, with the free end of the first leg being pivotally mounted to the first mount and the free end of the second leg being pivotally mounted to the second mount about a lift axis; means for pivoting the lift module relative to the mounts between a retracted position and a lift position, with the central spindle being adjacent the attachment surface in the retracted position and being spaced from the attachment surface in the lift position; and a pad pivotally mounted to the central spindle about a pad axis and including a first linear plate extending between the first and second legs for providing a support surface with the bottom of the water body.

2. The lift of claim 1 wherein the central spindle has a cylindrical outer surface; and wherein the pad is pivotally mounted to the central spindle by U-shaped straps extending around the central spindle and secured to the pad.

3. The lift of claim 1 wherein the central spindle has a cylindrical outer surface; and wherein the first linear plate extends tangentially to the outer surface of the central spindle, with the first linear plate including a free edge which abuts with the legs of the lift module in the retracted position to hold the first linear plate parallel to the attachment surface.

4. The lift of claim 3 wherein the pad includes a front linear plate extending from the first linear plate at an acute angle on the opposite side of the central spindle than the free edge; and wherein the first and second mounts each include an elongated brace extending perpendicular to the lift axis, with the front linear plate having a free edge which abuts with the elongated braces of the first and second mounts.

5. Lift for a watercraft having an attachment surface comprising, in combination: first and second mounts securable to the attachment surface of the watercraft in a spaced relation; a lift module of a generally U-shape and including first and second legs extending from a central spindle and having free ends, with the free end of the first leg being pivotally mounted to the first mount and the free end of the second leg being pivotally mounted to the second mount about a lift axis; and means for pivoting the lift module relative to the mounts between a retracted position and a lift position, with the central spindle being adjacent the attachment surface in the retracted position and being spaced from the attachment surface in the lift position, wherein the first and second legs have a variable length and each comprises, in combination: a C-shaped post; and a tube having an annular cross section for slideably receiving the C-shaped post in a slide direction, with the C-shaped post including a central portion and first and second leg portions extending from the central portion and having free edges, with the tube including first and second, parallel side walls, with the central portion of the C-shaped post slideably abutting the first side wall and the free edges of the leg portions abutting the second side wall, with the first side wall including an aperture and the central portion including a series of apertures in the slide direction of the C-shaped post in the tube; a sleeve secured to the second side wall and having a free end slideably abutting the central portion opposite to the first side wall; and means extendable through the apertures of the first side wall and the central portion and into the sleeve for preventing sliding of the C-shaped post in the tube.

6. The lift of claim 5 wherein the second side wall includes an aperture laterally aligned with the aperture of the first side wall; wherein the sleeve is secured to the second side wall by a bolt extending through the aperture of the second side wall and threadably received in the sleeve; and wherein the preventing means is threadably received in the sleeve.

7. Lift for a watercraft having an attachment surface comprising, in combination: first and second mounts securable to the attachment surface of the watercraft in a spaced relation; a lift module of a generally U-shape and including first and second legs extending from a central spindle and having free ends, with the free end of the first leg being pivotally mounted to the first mount and the free end of the second leg being pivotally mounted to the second mount about a lift axis; and means for pivoting the lift module relative to the mounts between a retracted position and a lift position, with the central spindle being adjacent the attachment surface in the retracted position and being spaced from the attachment surface in the lift position; wherein the free ends of each of the first and second legs include first and second, parallel, spaced, side walls extending perpendicular to the lift axis and having a thickness; and wherein each of the first and second legs further includes a pivot bushing having an inner bore; and a pivot pin extending from the mount for slideable and pivotable receipt in the inner bore of the pivot bushing, with the pivot pin defining the lift axis, with the pivot bushing having first and second axial ends, with the pivot bushing further including first and second radial shoulders formed in the inner bore spaced axially inward from the axial ends and having a radial depth generally equal to the thickness of the side walls, with each of the side walls including an aperture defined by a surface extending through the thickness of the side walls, with the side walls being deformed such that the surface abuts with the radial shoulders of the pivot bushing.

8. The lift of claim 7 wherein the pivot bushing further includes an outer surface, with the axial ends of the pivot bushing being arcuately contoured from the outer surface to the radial shoulders.

9. Lift for a watercraft having an attachment surface comprising, in combination: first and second mounts securable to the attachment surface of the watercraft in a spaced relation; a lift module of a generally U-shape and including first and second legs extending from a central spindle and having free ends, with the free end of the first leg being pivotally mounted to the first mount and the free end of the second leg being pivotally mounted to the second mount about a lift axis; and means for pivoting the lift module relative to the mounts between a retracted position and a lift position, with the central spindle being adjacent the attachment surface in the retracted position and being spaced from the attachment surface in the lift position; wherein each of the first and second legs comprises, in combination: a first elongated member and a second elongated member extending parallel to and spaced in a first direction from the first elongated member; wherein each of the first and second mounts comprises, in combination: a first elongated brace and a second elongated brace extending parallel to and spaced in the first direction from the first elongated brace, with the spacing of the elongated braces being greater than the width of and for pivotable receipt of the first and second elongated members in the first direction, with the first direction being parallel to the lift axis.

10. The lift of claim 9 wherein the pivoting means comprises, in combination: an extendable and retractable actuator having a first end and a second end, with the length between the first and second ends being variable when the actuator extends and retracts, with the first end of the actuator being pivotally secured to and between the first and second elongated members about an axis parallel to but spaced from the lift axis and the second end of the actuator being pivotally secured to and between the first and second elongated braces, with the actuator having a size in the first direction less than and for pivotable receipt within the spacing of the first and second elongated members.

11. The lift of claim 10 wherein the watercraft is a pontoon boat including a platform having the attachment surface and first and second, spaced, parallel, flotation units, with the first and second mounts located intermediate the flotation units and the lift axis extending perpendicular to the flotation units, with the flotation units having a bottom surface having a depth below the lift axis; and wherein the axis of the first end of the actuator is spaced from the lift axis less than the depth.

12. The lift of claim 5 wherein the watercraft is a pontoon boat including a platform having the attachment surface and first and second, spaced, parallel, flotation units, with the first and second mounts located intermediate the flotation units and the lift axis extending perpendicular to the flotation units.

13. Lift for a watercraft having an attachment surface comprising, in combination: a mount securable to the attachment surface of the watercraft, with the mount comprising, in combination: a first elongated brace and a second elongated brace extending parallel to and spaced in a first direction from the first elongated brace; a leg having a free end, with the free end of the leg being pivotally mounted to the mount about a lift axis; and means for pivoting the leg relative to the mount between a retracted position and a lift position, with the leg being adjacent the attachment surface in the retracted position and extending at an acute angle from the attachment surface in the lift position, with the leg comprising, in combination: a first elongated member and a second elongated member extending parallel to and spaced in the first direction from the first elongated member, with the spacing of the elongated braces being greater than the width of and for pivotable receipt of the first and second elongated members in the first direction, with the first direction being parallel to the lift axis; wherein the pivoting means comprises, in combination: an extendable and retractable actuator having a first end and a second end, with the length between the first and second ends being variable when the actuator extends and retracts, with the first end of the actuator being pivotally secured to and between the first and second elongated members about an axis parallel to but spaced from the lift axis and the second end of the actuator being pivotally secured to and between the first and second elongated braces, with the actuator having a size in the first direction less than and for pivotable receipt within the spacing of the first and second elongated members.

14. The lift of claim 13 wherein the watercraft is a pontoon boat including a platform having the attachment surface and first and second, spaced, parallel, flotation units, with the flotation units having a bottom surface having a depth below the lift axis; and wherein the axis of the first end of the actuator is spaced from the lift axis less than the depth.

15. Lift for a watercraft having an attachment surface comprising, in combination: a mount securable to the attachment surface of the watercraft; a leg of a variable length and having a free end, with the free end of the leg being pivotally mounted to the mount about a lift axis; and means for pivoting the leg relative to the mount between a retracted position and a lift position, with the leg being adjacent the attachment surface in the retracted position and extending at an acute angle from the attachment surface in the lift position, with the leg comprising, in combination: a C-shaped post; and a tube having an annular cross section for slideably receiving the C-shaped post in a slide direction, with the C-shaped post including a central portion and first and second leg portions extending from the central portion and having free edges, with the tube including first and second, parallel side walls, with the central portion of the C-shaped post slideably abutting the first side wall and the free edges of the leg portions abutting the second side wall, with the first side wall including an aperture and the central portion including a series of apertures in the slide direction of the C-shaped post in the tube; a sleeve secured to the second side wall and having a free end slideably abutting the central portion opposite to the first side wall; and means extendable through the apertures of the first side wall and the central portion and into the sleeve for preventing sliding of the C-shaped post in the tube.

16. The lift of claim 15 wherein the second side wall includes an aperture laterally aligned with the aperture of the first side wall; wherein the sleeve is secured to the second side wall by a bolt extending through the aperture of the second side wall and threadably received in the sleeve; and wherein the preventing means is threadably received in the sleeve.

17. Lift for a watercraft having an attachment surface comprising, in combination: a mount securable to the attachment surface of the watercraft, with the mount comprising, in combination: a first elongated brace and a second elongated brace extending parallel to and spaced in a first direction from the first elongated brace; a leg having a free end and an opposite end, with the free end of the leg being pivotally mounted to the mount about a lift axis; means for pivoting the leg relative to the mount between a retracted position and a lift position, with the leg being adjacent the attachment surface in the retracted position and extending at an acute angle from the attachment surface in the lift position, with the leg comprising, in combination: a first elongated member and a second elongated member extending parallel to and spaced in the first direction from the first elongated member, with the spacing of the elongated braces being greater than the width of and for pivotable receipt of the first and second elongated members in the first direction, with the first direction being parallel to the lift axis; and a pad pivotally mounted to the opposite end of the leg about a pad axis and for providing a support surface with the bottom of the water body, with the pad having a first linear plate including a free edge which abuts with the leg in the retracted position to hold the first linear plate parallel to the attachment surface.

18. Lift for a watercraft having an attachment surface comprising, in combination: a mount securable to the attachment surface of the watercraft, with the mount comprising, in combination: a first elongated brace and a second elongated brace extending parallel to and spaced in a first direction from the first elongated brace; a leg having a free end, with the free end of the leg being pivotally mounted to the mount about a lift axis; means for pivoting the leg relative to the mount between a retracted position and a lift position, with the leg being adjacent the attachment surface in the retracted position and extending at an acute angle from the attachment surface in the lift position, with the leg comprising, in combination: a first elongated member and a second elongated member extending parallel to and spaced in the first direction from the first elongated member, with the spacing of the elongated braces being greater than the width of and for pivotable receipt of the first and second elongated members in the first direction, with the first direction being parallel to the lift axis; and first and second guide pads, with the elongated braces each including an inside surface and an edge, with the guide pads each including a body portion and a head portion, with the head portion including a shoulder for abutting with the edge of the elongated brace and an inclined inner surface, with the first guide pad secured to the first elongated brace with the body portion engaging the inside surface of the first elongated brace and the second guide pad secured to the second elongated brace with the body portion engaging the inside surface of the second elongated brace, with the first and second elongated members each having an outer surface for camming against the inclined inner surfaces of the first and second guide pads as the first and second elongated members are being pivotally received in the spacing of the elongated braces.

19. Pivot assembly comprising, in combination: a leg having a free end including first and second, parallel, side walls each having a thickness, with the first and second side walls being at a fixed spacing; and a pivot bushing having an inner bore for slideable and pivotable receipt of a pivot pin, with the pivot pin defining an axis, with the pivot bushing having first and second axial ends, with the pivot bushing having a spacing between the first and second axial ends generally equal to the fixed spacing between the first and second side walls and for slideable receipt between the first and second walls, with the pivot bushing further including first and second radial shoulders formed in the inner bore spaced axially inward from the axial ends and having a radial depth generally equal to the thickness of the side walls, with each of the side walls including an aperture defined by a surface extending through the thickness of the side walls, with the side walls being deformed after the receipt of the pivot bushing such that the surface abuts with the radial shoulders of the pivot bushing for rigidly securing the pivot bushing between the first and second side walls with the pivot pin being slideable and pivotable in the apertures of the first and second side walls and the inner bore of the pivot bushing when the pivot bushing is rigidly secured between the first and second side walls.

20. The pivot assembly of claim 19 wherein the side walls are deformed such that the surface flushly abuts with the radial shoulders of the pivot bushing and extends radially to the inner bore.

21. The pivot assembly of claim 19 wherein the pivot bushing further includes an outer surface, with the axial ends of the pivot bushing being arcuately contoured from the outer surface to the radial shoulders.

22. Pontoon boat for use on a body of water including a bottom comprising, in combination: a platform having a front, a rear, opposite sides and an attachment surface; first and second, spaced, parallel, flotation units located on the platform adjacent the opposite sides; first, second, third, and fourth mounts secured to the attachment surface in a spaced relation and parallel to and adjacent the flotation units; first and second lift modules of a generally U-shape and each including first and second legs extending from a central spindle and having free ends, with the free end of the first leg of the first lift module being pivotally mounted to the first mount and the free end of the second leg of the first lift module being pivotally mounted to the second mount about a first lift axis perpendicular to the flotation units and adjacent the front of the platform, with the free end of the first leg of the second lift module being pivotally mounted to the third mount and the free end of the second leg of the second lift module being pivotally mounted to the fourth mount about a second lift axis perpendicular to the flotation units and adjacent the rear of the platform, with the first and second lift axes being in a spaced, parallel relation; and means for pivoting the first and second lift modules relative to the mounts between a retracted position and a lift position, with the central spindles of the first and second lift modules being adjacent the attachment surface in the retracted position and above the body of water and being spaced from the attachment surface in the lift position, with the central spindle of the first lift module located forward of the first and second lift axes in the retracted position and the central spindle of the second lift module located forward of the second lift axis and behind the first lift axis in the retracted position, with the first and second lift modules positioned relative to the platform such that the central spindles of the first and second lift modules engage the bottom of the body of the water in the lift position to position the flotation units above the body of water.

23. The pontoon boat of claim 22 wherein the pivoting means comprises, in combination: means for pivoting the first lift module relative to the first and second mounts between the retracted position and the lift position; and means for pivoting the second lift module relative to the third and fourth mounts between the retracted position and the lift position and which is independently operable from the means for pivoting the first lift module.

* * * * *